United States Patent [19]

Tanimoto et al.

[11] 4,455,615

[45] Jun. 19, 1984

[54] INTONATION-VARYING AUDIO OUTPUT DEVICE IN ELECTRONIC TRANSLATOR

[75] Inventors: Akira Tanimoto, Kashihara; Mitsuhiro Saiji, Kyoto, both of Japan

[73] Assignee: Sharp Kabushiki Kaisha, Osaka, Japan

[21] Appl. No.: 315,855

[22] Filed: Oct. 28, 1981

[30] Foreign Application Priority Data

Oct. 28, 1980 [JP] Japan ..... 55-152856

[51] Int. Cl.[3] ..... G10L 1/60

[52] U.S. Cl. ..... 364/513.5; 381/51

[58] Field of Search ..... 179/1 SM, 1 SE; 364/513; 340/148; 381/51-53

[56] References Cited

U.S. PATENT DOCUMENTS 3,928,722 12/1975 Nakata et al. ..... 179/1 SM

FOREIGN PATENT DOCUMENTS 2014765 8/1979 United Kingdom .

OTHER PUBLICATIONS

Fallside, et al., "Speech Output From a Computer-Controlled Network", Proc. IEE, Feb. 1978, pp. 157-161.

Wiefall, "Microprocessor Based Voice Synthesizer", Digital Design, Mar. 1977, pp. 15-16.

*Primary Examiner*—E. S. Matt Kemeny

*Attorney, Agent, or Firm*—Birch, Stewart, Kolasch & Birch

[57] ABSTRACT

An electronic translator is capable of preparing sentences on the basis of old sentences stored in a memory and different voice data for the new sentences are outputted, the intonations depending on the position of one or more changeable words in the new sentences and the syntax of the new sentence. A voice memory is provided for sorting different voice data for the one or more words depending on the position of the one or more words in the new sentences and the syntax of the new sentences. The new sentences are voice synthesized using the different voice data to provide audible outputs having different intonations.

13 Claims, 3 Drawing Figures

INTONATION-VARYING AUDIO OUTPUT DEVICE IN ELECTRONIC TRANSLATOR

BACKGROUND OF THE INVENTION

The present invention relates to an electronic translator and, more particularly, to an audio output device suitable for an electronic translator which provides a verbal output of a word or sentence.

Recently, a new type of electronic device called an electronic translator has been available on the market. The electronic translator differs from conventional types of electronic devices in that the former is of a unique structure which provides for efficient and rapid retrieval of word information stored in a memory.

When such an electronic translator is implemented with an audio output device in order to provide verbal output of words or sentences, it is desirable that the audio output device can provide, with natural intonations, words, in particular, the last words in the sentences, depending on whether the sentence is declarative or interrogative.

SUMMARY OF THE INVENTION

Accordingly, it is an object of the present invention to provide an improved audio output device suitable for an electronic translator.

It is another object of the present invention to provide an improved audio output device for providing words with different intonations.

Briefly described, in accordance with the present invention, an electronic translator comprises means for forming new sentences prepared on the basis of old sentences stored in a memory and means for outputting different voice data related to the new sentences varying the intonations depending on the position of one or more words changed in the new sentences and the syntax of the new sentences. A voice memory is provided for storing different voice data of the one or more words. Depending on the position of the one or more words in the new sentences and the syntax of the new sentences, the new sentences are voice synthesized using the respective different voice data to provide different audible outputs of different intonations.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE INVENTION

First of all, any language can be applied to an electronic translator of the present invention. An input word is spelled in a specific language to obtain an equivalent word, or a translated word spelled in a different language corresponding thereto. The languages can be freely selected.

Figure 1:
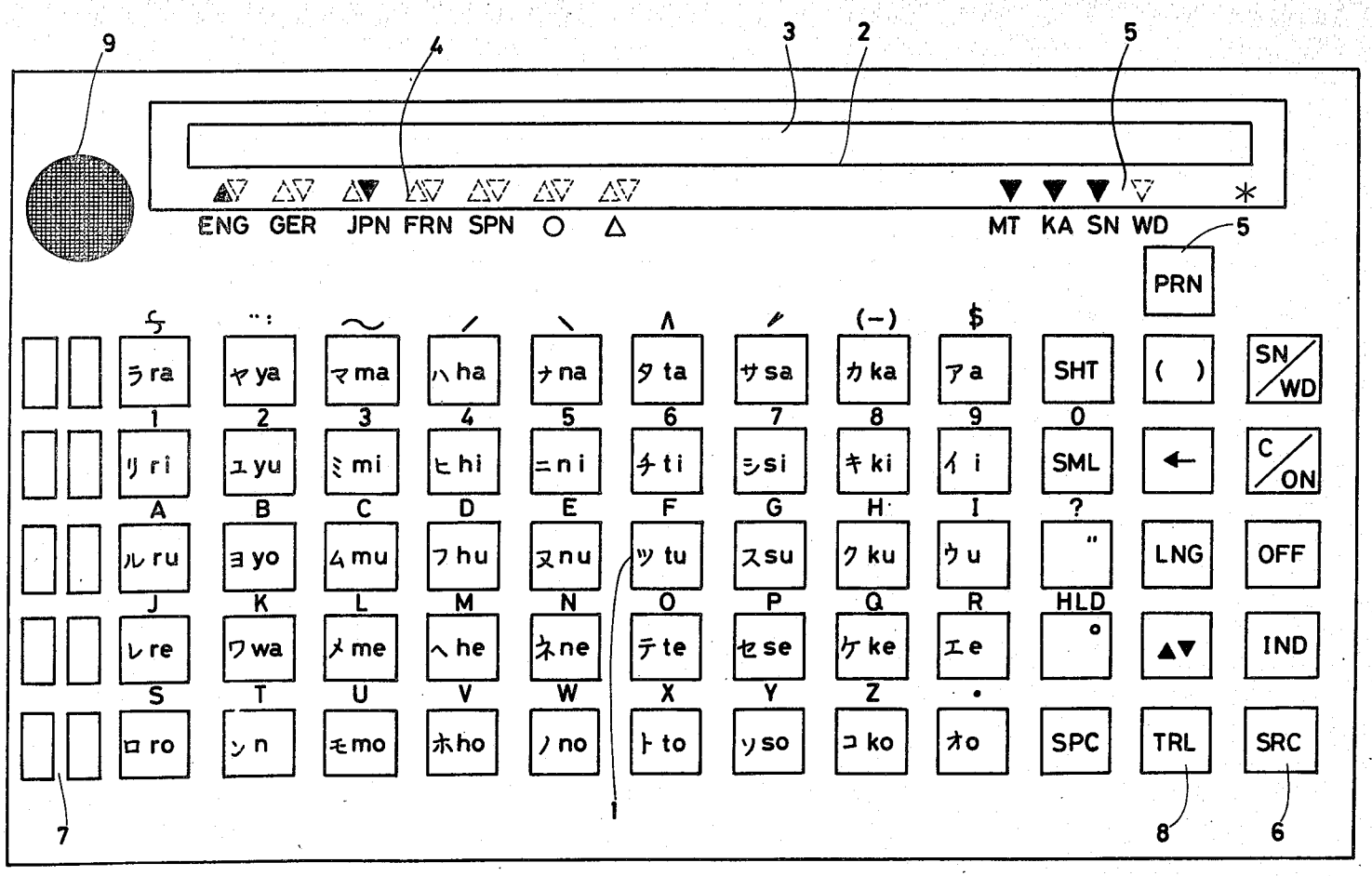
FIG. 1 shows a plan view of an electronic translator which may embody means according to the present invention.

Referring now to FIG. 1, there is illustrated an electronic translator according to the present invention. The translator comprises a keyboard 1 containing a Japanese syllabary keyboard, an English alphabetical keyboard, a symbol keyboard, and a functional keyboard, an indicator 2 including a character display or indicator 3, a language indicator 4 and a symbol indicator 5.

The character display 3 shows characters processed by the translator. The language indicator 4 shows symbols used for representing the mother language and the foreign language processed by the translator. The symbol indicator 5 shows symbols used for indicating operational conditions in this translator.

Further, a pronunciation (PRN) key 5 is actuated for instructing the device to pronounce words, phrases, or sentences. Several category keys 7 are provided. A selected one may be actuated to select sentences classified into a corresponding groups, for example, a groups of sentences necessary for conversations in airports, group of sentences necessary for conversations in hotels, etc. A translation (TRL) key 8 is actuated to translate the words, the phrases, and the sentences. A loudspeaker 9 is provided for delivering an audible output in synthesized human voices for the words, the phrases, and the sentences.

Figure 2:
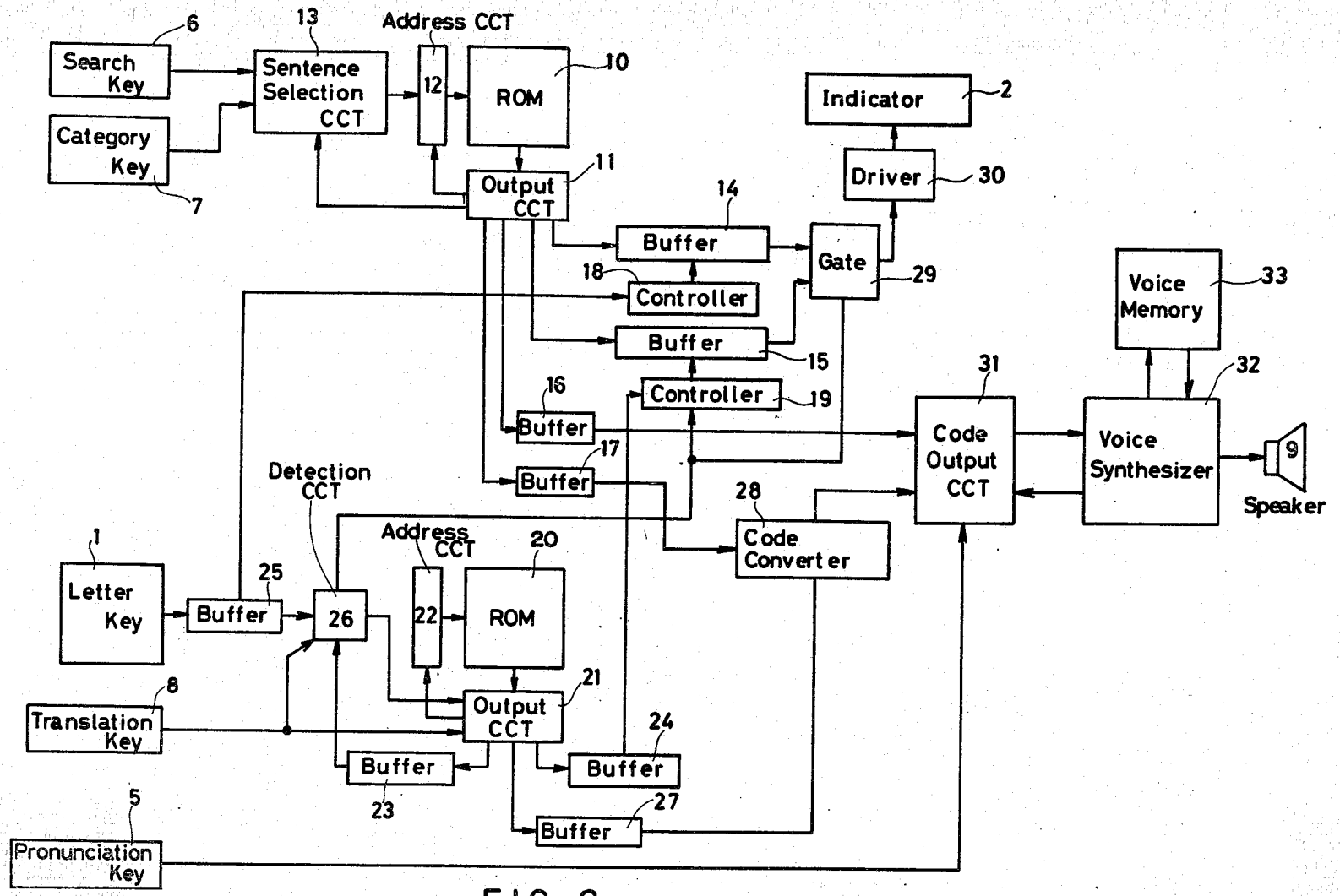
FIG. 2 shows a block diagram of a control circuit implemented within the translator as shown in FIG. 1.

FIG. 2 shows a control circuit of the translator of FIG. 1. Like elements corresponding to those of FIG. 1 are indicated by like numerals.

A ROM 10 is provided for storing the following data in connection with the respective sentences.

(1) the spelling of the sentence in the mother language
(2) the spelling of the sentence in the foreign language
(3) parentheses for enclosing one or more changeable words in the spellings of the above two sentences.

Required bytes are allotted for the respective information. The respective sentences are separated by separation codes. When there are no changeable words contained in the sentences, no information for the parentheses is stored. A desired group of sentences is generated by actuating the corresponding category key 7. Each time the search key 6 is actuated, a sentence is developed from memory. The respective sentences are seriatim developed in a selected category. Thus, the ROM 10 stores all the sentences in groups related to the categories.

An output circuit 11 controls output of information from ROM 10. The circuit 11 counts the separation codes retrieved from the ROM 10 in retrieving a specific sentence sought. An address circuit 12 controls the location addressed in the ROM 10. A sentence selection circuit 13 is response to the selection by the category key 7 actuated for retrieving the head or first sentence in the selected category from the ROM 10. A buffer 14 stores the mother language sentences from the ROM 10. A buffer 15 stores the foreign language sentences from the ROM 10. A buffer 16 stores sentence codes. A buffer 17 stores the parentheses information.

A controller 18 is operated to replace the one or more changeable words in the mother language sentence stored in the buffer 14 with one or more new words. A controller 19 is operated to replace the one or more changeable words in the foreign language sentence stored in the buffer 15 with one or more new words. A ROM 20 is provided for storing the following information with respect to a plurality of words:

(1) the spelling of the word in the foreign language
(2) the spelling of the word in the foreign language (3) a word code An output circuit 21 controls output from the ROM 20. An address circuit 22 is provided for selecting the location addressed in the ROM 20. A buffer 23 stores the mother language words output from ROM 20. A buffer 24 stores the foreign language words. A buffer 25 stores words entered by the keyboard 1. A detection circuit 26 determines the equivalency between the mother language word spellings read out of the ROM 20 and the word spellings entered by the keyboard 1. A buffer 27 stores the word codes derived from the ROM 20 through the output circuit 21.

The word codes entered into the buffer 27 are used to provide the audible outputs corresponding thereto. A code converter 28 converts the word codes stored in the buffer 27, depending on the parentheses information stored in the buffer 17. That is, the converter 28 supplies the codes leading to the voice information of the words within the parentheses in the sentences. A code output circuit 31 is provided.

The sentence codes stored in the buffer 16 are used to select the voice information of the sentences. A voice memory 33 stores data of the voice information of the sentences. The word codes stored in the buffer 27 are outputted into a voice synthesizer 32 by the code output circuit 31, responsive to the parentheses information of the buffer 17. The voice memory 33 further stores two or more different kinds of voice information with respect to words having the same spelling. Then, a specific kind of voice information for such words is selected dependent upon the parentheses code detection information received from the voice synthesizer 32.

In operation, one of the category keys 7 is actuated to retrieve the head sentence of the selected caterogy from the ROM 10 by operating the address circuit 12 and the sentence selection circuit 13. The separation codes of the sentences from the ROM 10 are counted for this purpose. For the sentences retrieved from the ROM 10, the mother language sentences are stored in the buffer 14, the foreign language sentences are stored in the buffer 15, the sentence codes are stored in the buffer 16, and the parentheses information is stored in the buffer 17. The mother language sentences are forwarded into the indicator 2 through a gate 29 and a driver 30 for displaying purposes.

When a specific sentence retrieved and displayed contains the parentheses and one or more changeable words in the parentheses are to be changed, the keyboard 1 may be operated to enter any word or words into the buffer 25. The contents of the buffer 25 are supplied to the controller 18 so that the changeable word or words in the buffer 14 containing the mother language sentence are changed. The thus prepared sentence is displayed by the indicator 2.

Thereafter, the translation key 8 is actuated to operate the output circuit 21, so that the words are sequentially read out of the ROM 20 which stores the words. The buffers 23, 24 and 27 store the mother language word spelling, the foreign language word spelling and the word code, respectively. The word spelling entered into the buffer 25 is seriatim compared by circuit 26 with the mother language word spellings placed into the buffer 23 from the ROM 20.

When they do not agree, the ROM 20 continues to develop words. When they agree, the comparisons are halted and the mother language word spelling is in the buffer 23, its foreign language word spelling is in the buffer 24, and its word code is in the buffer 27.

The one or more changeable words, in the foreign language sentence, stored in the buffer 15 are replaced by the foreign language word spelling in the buffer 24. The thus prepared foreign language sentence in the buffer 15 is forwarded into the indicator 2 for displaying purposes, by operating the gate 29 in response to coincidence detection signals generated from the detection circuit 26. Under these conditions, the pronunciation key 5 may be operated so that the code output circuit 31 causes the sentence code stored in the buffer 16 to be entered into the voice synthesizer 32. The voice synthesizer 32 generates synthetic speech corresponding to the sentence code entered therein, using its voice-synthesizing algorithm stored therein and voice data stored in the voice memory 33. Therefore, the speech information indicative of the sentence is outputted from the speaker 9.

Figure 3:
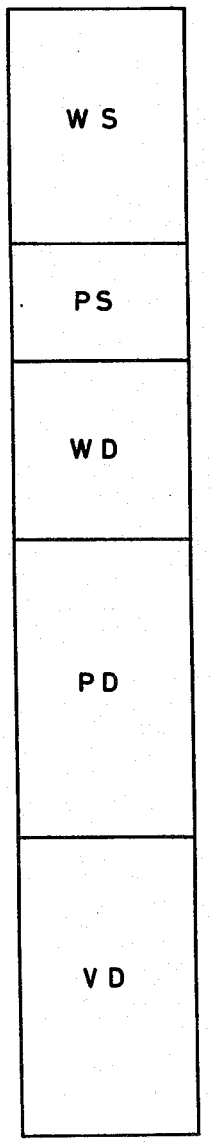
FIG. 3 shows a format of a ROM for storing voice data.

FIG. 3 shows a format of the voice memory (ROM) 33. In FIG. 3, WS indicates a word starting address table, PS indicates a sentence starting address table, WD indicates a word voice data region, PD indicates a sentence voice data region, and VD indicates a voice data region. After the ROM 10 generates the sentence code into the buffer 16, the sentence code is entered into the voice synthesizer 32.

A specific location of the sentence starting address table PS is addressed by the sentence code. The selected location of the table PS provides starting address information for addressing a specific location of the sentence voice data region PD. According to the selected contents of the region PD, data is read out of the voice data region VD to synthesize specific speech of the sentence.

When the sentence contains the parentheses for enclosing the one or more changeable words, the sentence voice data region VD stores parentheses codes. When the voice synthesizer 32 detects the parentheses codes from the voice memory 33 and outputs its detection signals to the code output circuit 31, the circuit 31 causes the word codes converted by the code converter 28 to be entered into the voice synthesizer 32. That is, after the word codes stored in the buffer 27 are sent to the code converter 28 and the converter 28 converts the codes depending on he parentheses information stored in the buffer 17, the thus converted codes are entered into the voice synthesizer 32.

Since the voice synthesizer 32 receives the converted word codes, the codes address a specific location of the word starting address table WS. The selected location of the table WS provides starting address information for addressing a specific location of the word voice data region WD. According to the selected contents of the region WD, data is read out of the voice data region VD to synthesize specific speech data of the word.

The voice data region VD stores the voice data for the words, the voice data being different depending on the different position of the same word spelling in the sentence. For example, the voice data may vary depending upon whether the sentence is declarative or interrogative for sentences which are interrogative (i.e., beginning with "WHAT") wherein the word is placed at the changeable last position of the sentence, the voice data of the word is stored as type A. When the sentence is declarative and the changeable word is placed at the last position of the sentence, the voice data of the word is stored as type B, different than type A. The voice data of these two types are stored adjacent each other.

When the word code "N" is converted with the parentheses information and the converted code is still "N", the voice data of the type A is selected and delivered. When the word code N is converted with the parentheses information and the converted code is "N+1", the voice data of the type B is selected and delivered. The word starting address table WS stores at least two starting addresses in connection with the same word spelling, if necessary. The code converter 28 is operated to add the selected number to the word codes in the buffer 27.

The converted code "N" based on the word code "N" is used, for example, for the word positioned as the last word of an interrogative sentence starting with an interrogative such as "WHAT". The converted code "N+1" based on the word code "N+1" is used for the word positioned as the last word of a declarative sentence.

Example 1

The mother language: Japanese
The foreign language: English
A sentence retrieved from the ROM 10:

(ニホンゴ") ヲ ハナセマ セン

I DON'T SPEAK (JAPANESE).

When the above sentence is retrieved from the ROM 10, the respective buffers store the following contents.
The buffer 14: (ニホンゴ") ヲ ハナセマセン
The buffer 15: I DON'T SPEAK (JAPANESE).
The buffer 16: 213
The buffer 17: 0

The changeable word within the parentheses is changed by entering " エイゴ " ("ENGLISH") with the keyboard 1. When the translation key 8 is actuated and the word entered by the keyboard is retrieved from ROM 20, as described above, the respective buffers store the following contents:
The buffer 23: エイゴ"
The buffer 24: ENGLISH
The buffer 25: エイゴ"
The buffer 27: 3715
The buffer 15: I DON'T SPEAK (ENGLISH).

The pronunciation key 5 is actuated to commence to develop the speech data of the sentence specified with the sentence code 213. For the changed word "ENGLISH" within the parentheses, the speech data defined by the code corresponding to the word code of 3715 is selected and delivered.

Therefore, the speech data of the sentence delivered has the following declarative intonation:
I DON'T SPEAK ENGLISH The word code of 3715 is used to lead to the speech data of the word with the following declarative intonation:
ENGLISH Example 2

The mother language: Japanese
The foreign language: English
A sentence retrieved from the ROM 10:

(ニホンゴ" ヲ ハナシマスカ)

DO YOU SPEAK (JAPANESE)?

A modified sentence (based upon contents of buffers 23–25 and 27 as noted above):

(エイゴ") ヲ ハナシマスカ

DO YOU SPEAK (ENGLISH)?

The ROM 10 develops the following information to the respective buffers:
The buffer 14:
The buffer 15: DO YOU SPEAK (JAPANESE)?
The buffer 16: 226
The buffer 17: 1

Since the buffer 17 stores the parentheses information of 1, the code converter 28 operates so that the parentheses information of 1 is added to the word code of 3715 developed from the buffer 27 to obtain the converted code of 3716. The code of 3716 leads to additional or alternate speech data of the word enclosed within the parentheses.

The speech data specified by the converted code of 3716 is as follows, yielding an interrogative intonation:
ENGLISH Therefore, the speech data of the translation in English of the modified sentence is as follows:
DO YOU SPEAK ENGLISH?

The invention being thus described, it will be obvious that the same may ve varied in many ways. Such variations are not to be regarded as a departure from the spirit and scope of the invention, and all such modifications are intended to be included within the scope of the following claims.

What is claimed is:

1. An electronic translator comprising:

sentence generating means for providing at least one first sentence in a first language and at least one equivalent second sentence in a second language;

replacing means connected to said sentence generating means for replacing at least one changeable word in said first sentence with another word in said first language for making an altered first sentence;

word translating means connected to said replacing means and to said sentence generating means for providing a translated word in said second language equivalent to said another word to said sentence generating means for making an altered second sentence equivalent to said altered first sentence;

voice synthesizer means connected to said sentence generating means and to said word translating means for synthesizing voice output representing said altered second sentence;

voice data memory means connected to said voice synthesizer means for storing first voice data corresponding to second sentences provided by said sentence generating means and plural sets of second voice data corresponding to each translated word provided by said word translating means, and for providing selected voice data to said voice synthesizing means;

first determining means associated with said sentence generating means for determining which first voice data corresponding to a second sentence is provided to said voice synthesizer means;

second determining means associated with said word translating means for determining which of said plural sets of second voice data corresponding to a translated word is provided to said voice synthesizer means; and means associated with said first and second determining means for replacing a portion of said first voice data provided to said voice synthesizer means with second voice data, wherein the content of said provided second voice data is dependent upon the positions of said another word in said altered first sentence and said translated word in said altered second sentence.

2. A translator as in claim 1, wherein said replacing means comprises word input means.

3. A translator as in claim 1 wherein said sentence generating means comprises a sentence memory means for storing sentences in said first language, equivalent sentences in said second language, and sentence codes representative of said second sentences; and means for retrieving said sentences and sentence codes from said sentence memory means.

4. A translator as in claim 1, wherein said word translating means comprises a word memory means for storing words in said first language, equivalent words in said second language, and word codes representative of said equivalent words; and means for retrieving said words and word codes from said word memory means.

5. A translator as in claim 3, wherein said first determining means comprises means for receiving said sentence codes and for providing said sentence codes to said voice synthesizer means.

6. A translator as in claim 4, wherein said second determining means comprises means for receiving said word codes and providing said word codes to said voice synthesizer means.

7. A translator as in claim 3 wherein said word translating means comprises a word memory for storing words in said first language, equivalent words in said second language, and word codes representative of said equivalent words; and means for retrieving said words and word codes from said word memory means.

8. A translator as in claim 7 wherein said first determining means comprises means for receiving said sentence codes and for providing said sentence codes to said voice synthesizer means; and said second determining means comprises means for receiving said word codes and for providing said word codes to said voice synthesizer means.

9. A translator as in claim 8 wherein said means for replacing a portion of said first voice data comprises code receiving means associated with said voice synthesizer means for receiving said sentence codes and said word codes.

10. The transistor of claim 1, further comprising means connected to said sentence generating means for providing additional data indicating the position of the changeable word or words in said first sentence.

11. A translator as in claim 1, wherein said respective sets of second voice data corresponding to each translated word varies the intonation of said translated word output by said voice synthesizer means.

12. A translator as in claim 1, wherein the content of said provided second voice data is dependent on the syntax of the altered second sentence.

13. A translator as in claim 6, comprising code converting means for converting word codes provided to said voice synthesis means.

* * * * *